United States Patent [19]

Witt et al.

[11] 4,195,550

[45] Apr. 1, 1980

[54] PROPELLENT CHARGE IGNITER FOR CASELESS CARTRIDGES OF SEPARATELY LOADED AMMUNITION

[75] Inventors: Wolfram Witt; Karlheinz Reinelt, both of Duesseldorf, Fed. Rep. of Germany

[73] Assignee: Rheinmetall GmbH, Duesseldorf, Fed. Rep. of Germany

[21] Appl. No.: 902,669

[22] Filed: May 4, 1978

[30] Foreign Application Priority Data

May 27, 1977 [DE] Fed. Rep. of Germany ..... 2723983

[51] Int. Cl.[2] ..... F41F 13/00

[52] U.S. Cl. ..... 89/27 B; 102/38 R; 102/204

[58] Field of Search ..... 89/27 B, 27 C; 102/38 R, 39, 40, 45, 66, 97, 202, 204

[56] References Cited

U.S. PATENT DOCUMENTS

| | | | |
|---|---|---|---|
| 308,941 | 12/1884 | Yates | 102/97 |
| 588,443 | 8/1897 | Kendall | 102/38 R |
| 831,947 | 9/1906 | Graeme et al. | 102/204 |
| 3,099,937 | 8/1963 | Bartels | 89/27 B |
| 3,348,484 | 10/1967 | Grandy | 102/DIG. 7 |

*Primary Examiner*—Stephen C. Bentley

[57] ABSTRACT

A propellent charge igniter for caseless cartridges of separately loaded ammunition. The igniter has an ignition chain which includes a secondary charge adjoining a main charge made up of powder pipes or tubes. The secondary charge is disposed in pierceable bag material. A booster charge is disposed in a cartridge case which is mounted in the movable breech block. A combustible projectile is mounted in the cartridge case, and is adapted to be ejected from the cartridge case by the gases generated by the booster charge to pierce the bag material and ignite the secondary charge.

4 Claims, 3 Drawing Figures

PROPELLENT CHARGE IGNITER FOR CASELESS CARTRIDGES OF SEPARATELY LOADED AMMUNITION

BACKGROUND OF THE INVENTION

The invention pertains to a propellent charge igniter arrangement for caseless cartridges of separately loaded ammunition. Such ammunition is ignited by means of an igniting chain including a primer and a booster charge. These types of charge arrangements of the known propellent charge igniters generally have relatively long ignition delay times and an increased spreading effect. These effects can be attributed primarily to an excessively strong bag material for the secondary and propellent charge, a multi-layer material being used between the secondary and propellent charge which inhibits a definable burn in the secondary and propellent charge; and finally the fact that excessively long ignition ducts are used with weakly charged primers.

All of the aforedescribed features prevent a reliable definable burning of the secondary and propellent charge.

SUMMARY OF THE INVENTION

It is a general object of this invention to eliminate the aforedescribed disadvantages of the state of the art propellent charge igniters. The object of the invention is achieved by providing a booster charge of the propellent charge igniter which includes one or more combustible projectiles which, on firing, penetrate the cartridge bag material of a secondary charge. The gases forming during ignition of the booster charge ignite the secondary charge.

According to another feature of the invention, the projectile may be combustible and can be composed of a propellent charge powder, which participates itself in the gas production during firing.

According to a preferred embodiment of the invention, the propellent charge igniter includes a striker, and ignition capsule, an ignition channel or duct which leads to the booster charge, a combustible projectile and a cartridge case which envelopes all of the components of the ignition chain.

This arrangement insures that in the build-up of the propellent charge igniter, the booster charge is ignited by means of the ignition capsule so that the therein embedded combustible projectile penetrates with high velocity and with partial destruction of the cartridge bag into the secondary charge thereby providing a cleared path for the unhindered penetration of the following gases of the booster charge into the secondary charge. By means of the aforedescribed features and steps of the invention, the ignition chain is improved in such a way that a shortening of the ignition delay time is effected as well as a reduction of the spreading effect caused by this delay time.

There are already known a number of proposals, whereby a rifle grenade, for example, is fired from a bowl by means of a rifle bullet (see German published application No. 2,057,591). In this known arrangement the rifle bullet merely serves to effect an ignition of the rifle grenade by penetrating into the ignition channel of the rifle grenade while the following outflowing propellent gases drive the grenade out of the firing bowl.

In an other known arrangement (see German published application No. 1,816,821) the rifle projectile as well as the propellent charge powder disposed in the rifle bullet effect a propelling and igniting of the rifle grenade.

BRIEF DESCRIPTION OF THE DRAWING

Two examplary embodiments of an arrangement in accordance with the invention are shown in the attached drawing, wherein.

DESCRIPTION OF PREFERRED EMBODIMENTS

Figure 1:
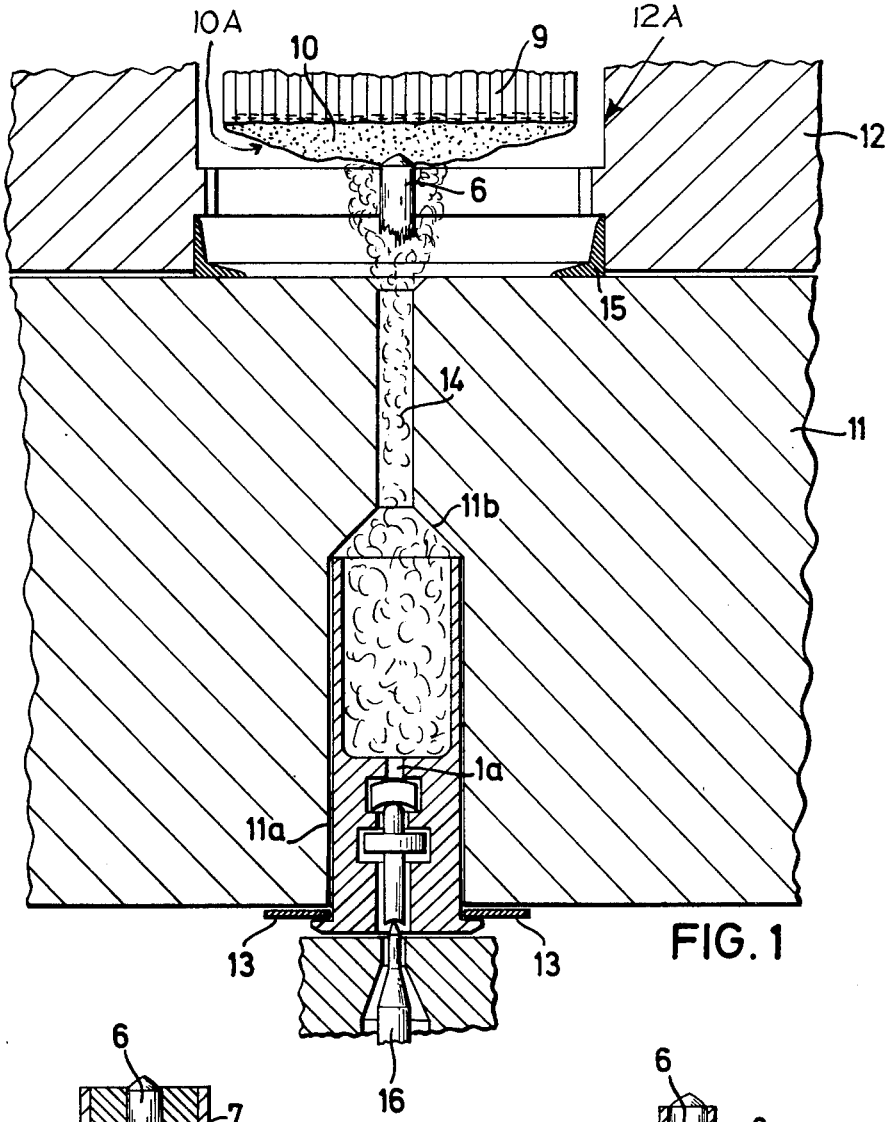
FIG. 1 illustrates a longitudinal cross-sectional view of a breech block having mounted therein a propellent charge igniter in conditions existing after firing.
Figure 2:
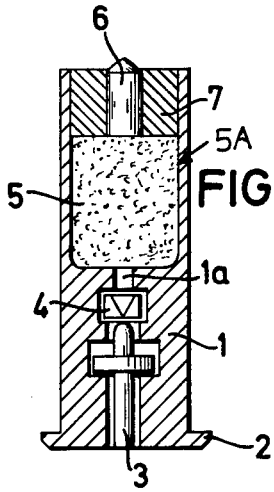
FIG. 2 is a cross-sectional view of the propellent charge igniter illustrated in FIG. 1 in conditions existing before firing.

Referring now to the drawing , there is illustrated in FIGS. 1 and 2 a propellent charge igniter which includes a cartridge case 1 in which there are disposed, starting with the base of the case 2, a striker 3, an ignition capsule 4 mounted coaxially in the case 1, and a booster charge 5 disposed in an axial bore 5*a*. The bore 5*a* is sealed by means of a projectile 6, composed of propellent charge powder, which is coaxially disposed in the bore 5*a* by means of a support and guide member 7 which simultaneously seals the upper opening of the bore 5*a*. The support and guide member 7 may also be made of material which is combustible. This member 7 serves to precisely centrally position and hold the projectile 6 as shown in FIG. 2.

Figure 3:
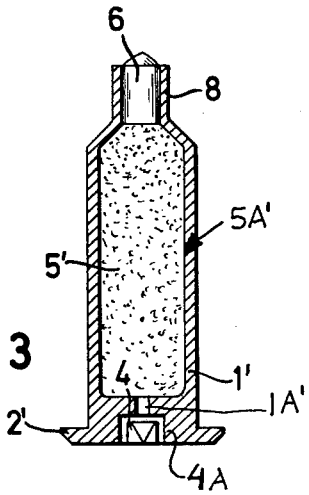
FIG. 3 is a longitudinal cross-sectional view of an alternate embodiment of a propellent charge igniter.

In the alternate embodiment of a propellent charge igniter as illustrated in FIG. 3, the ignition capsule 4 is mounted in an axial recess 4*a* extending axially outwardly from the base of the case 2'. The ignition capsule 4' is seated in the recess 4*a*. The cartridge case 1' has a constricted neck portion 8 in which the projectile 6 is seated. This embodiment of the propellent charge igniter dispenses with the striker 3 as well as the supporting guide member 7 of the embodiment of FIG. 2. The cartridge case 1' also has an axial bore 5*a'* in which the booster charge 5' is disposed.

The propellent charge igniter, illustrated in FIG. 1, operates as follows:

After the missile (not illustrated) and the caseless propellent charge 9, which may be composed out of powder tubes or powder, together with the secondary charge 10 affixed to the bottom thereof, have been introduced into the loading chamber 12*a* of the gun barrel 12 via the open breech block 11, the latter breech block 11 is repositioned in a closed position (see FIG. 1) and the propellent charge igniter 1 (or 1') is introduced into the propellent charge ignition housing 11*a* of the breech block 11. The edges of the base 2, 2' of the cartridge case 1, 1' are held by the claws of an ejector mechanism 13 as seen in FIG. 1. The propellent charge ignition housing 11*a* has a funnel shaped upper end 11*b* from which a duct or channel 14 extends axially into the loading chamber 12*a*.

The breech block 11, which is laterally movable relative to the gun barrel 12, is also gas tightly sealed to the outside by means of packing ring 15 which is mounted in a recess of the gun barrel 12 as seen in FIG. 1. When the striker pin 16 hits the striker 3 (or in the case of the embodiment of FIG. 3 hits the ignition capsule 4') the striker 3 (or in the case of the embodiment of FIG. 3 the striker pin 16 itself) ruptures the ignition capsule 4 (4' in FIG. 3) and the ignition flame passes through the short connecting passage 1*a*, 1*a'* and ignites the booster charge 5, 5', thereby forcing the projectile 6, moving in the manner of a high-speed like stopper or plug, through the ignition duct 14, into the powder bag 10*a* thereby rupturing it, when igniting the secondary charge 10 and leaving simultaneously behind the hot gases formed by the combustion of the booster charge 5, 5'. The packing ring 15 insures that the hot gases for igniting the secondary charge 10 are completely utilized without any residue. The secondary charge 10 generally occupies the entire base surface of the propellent charge 9 made out of pipe or tubes of powder 9. This insures that a uniform burning of the propellent charge 9 takes place. After the non-illustrated missile has been ejected from the gun barrel 12, the breech block 11 is again moved laterally to an open position and the ejector claws 13 can remove the empty cartridge case 1, 1' of the propellent charge igniter from the propellent charge igniter housing 11*a*.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A propellent charge igniter for caseless cartridges of separately loaded ammunition having an ignition chain, comprising in combination, a movable breech block having a first bore a cartridge case mounted in said first bore of said breech block a secondary charge disposed in a piercable bag material;

a booster charge including at least one projectile axially aligned therewith disposed in said cartridge case, which on firing is adapted to pierce said bag material whereby the gases generated by the booster charge are adopted to to ignite said charge;

an ignition capsule operatively and coaxially mounted in said cartridge case;

said cartridge case has a base portion and a top portion, said top portion being disposed most proximate to said secondary charge;

said base portion, having an axially extending second bore; and said ignition capsule axially extending in said second bore.

2. The propellent charge igniter according to claim 1, wherein said projectile is made at least partially of combustible material.

3. The propellent charge igniter according to claim 2, wherein said projectile is made of combustible propellent charge powder which itself produces gases when ignited.

4. The propellent charge igniter according to claim 7, wherein said cartridge case has a base portion and a top portion, a supporting member having a central bore extending therethrough and being supported in said cartridge case over said booster charge, said projectile being mounted in said central bore; a striker movably mounted in said second bore; said ignition capsule being disposed in said second bore between said striker and said booster charge.

* * * * *